US005697631A

United States Patent [19]

Ratzek et al.

[11] Patent Number: 5,697,631

[45] Date of Patent: Dec. 16, 1997

[54] SNOWBOARD BINDING

[75] Inventors: Thomas Ratzek, Rosenheim; Christian Niedermeier, Schechen, both of Germany

[73] Assignee: F2 International Ges.m.b.H., Kirchdorf/Krems, Austria

[21] Appl. No.: 434,566

[22] Filed: May 4, 1995

[30] Foreign Application Priority Data

May 6, 1994 [DE] Germany ..... 44 16 189.1
May 10, 1994 [DE] Germany ..... 44 16 531.5

[51] Int. Cl.[6] ..... A63C 9/20

[52] U.S. Cl. ..... 280/613; 280/617; 280/625; 280/14.2

[58] Field of Search ..... 280/613, 623, 280/624, 14.2, 617, 607, 625

[56] References Cited

U.S. PATENT DOCUMENTS

| | | | |
|---|---|---|---|
| 2,139,699 | 12/1938 | Segal | 280/11.2 |
| 3,608,919 | 9/1971 | Lollmann et al. | 280/613 |
| 3,779,570 | 12/1973 | Betschart, Jr. | 280/613 |
| 3,785,668 | 1/1974 | Market | 280/613 |
| 3,888,497 | 6/1975 | Zahradka | 280/624 |
| 3,905,613 | 9/1975 | Romeo | 280/11.35 |
| 3,964,758 | 6/1976 | Kent | 280/613 |
| 3,992,037 | 11/1976 | Frechin | 280/613 |
| 4,060,256 | 11/1977 | Collombin et al. | 280/613 |
| 4,083,129 | 4/1978 | Collombin et al. | 36/117 |
| 4,177,584 | 12/1979 | Beyl | 36/117 |
| 4,640,026 | 2/1987 | Kirsch | 36/117 |
| 4,653,203 | 3/1987 | De Mattheis | 280/613 X |
| 5,558,355 | 9/1996 | Henry | 280/624 |

FOREIGN PATENT DOCUMENTS

| | | |
|---|---|---|
| A-343302 | 11/1989 | European Pat. Off. . |
| 2200056 | 1/1972 | Germany . |
| 2511332 | 3/1975 | Germany . |
| 351419 | 11/1975 | Germany . |
| 2556817 | 12/1975 | Germany . |
| 2809018 | 3/1978 | Germany . |
| 3141425 | 10/1981 | Germany . |
| U-8801972 | 3/1988 | Germany . |
| 4106401 | 2/1991 | Germany . |
| 4311630 | 4/1993 | Germany . |
| A-682133 | 7/1993 | Switzerland . |

*Primary Examiner*—Brian L. Johnson
*Assistant Examiner*—Michael Mar
*Attorney, Agent, or Firm*—Senniger, Powers, Leavitt & Roedel

[57] ABSTRACT

The snowboard binding having a sole part integrated in the snowboard boot and a first binding element cooperating with it and continuously connected to the snowboard. The sole part has two spring-loaded pins projecting laterally out of the sole part and capable of engaging with an opening of the first binding element. The pins can be retracted with a device attached to the snowboard boot and thus the binding can be opened.

23 Claims, 15 Drawing Sheets

SNOWBOARD BINDING

BACKGROUND OF THE INVENTION

The invention pertains to a snowboard binding for use by a snowboarder for releasably binding a snowboard boot to a snowboard.

One type of snowboard binding was exhibited at an ISPO trade fair in Munich, Germany on Feb. 24, 1994 and subsequently described in DE 4,311,630 A1. This binding had a front stirrup rigidly connected to the snowboard which reached over the front part of the boot sole and thus held it in place. A pin running transversely to the boot's longitudinal axis was inserted through the heel-side part of the boot sole and projected about 5–10 mm from the boot sole at both sides. A heel element to be screwed firmly in place on the snowboard consisted of two lateral cheeks running parallel and projecting vertically from the snowboard surface; these had a vertically oriented slot, into which the part of the pin projecting out of the shoe could be introduced. A catch device on the lateral cheeks had the form of a hook which was pushed back during introduction of the pins into the slots and thus opened them, while with the pin parts completely housed in the slots it snapped into locking position and thus engaged the pins. In order to open the binding, a lever on one of the lateral cheeks had to be operated, by which means the stirrups could be moved into the opening position and the heel part of the shoe could be moved from the binding.

AT 351,419 shows a ski binding with a shell nearly completely encompassing the skier's boot that can be folded open and is fastened tightly to the surface of the ski. A shell part covering the front part of the foot and one covering the front side of the shin are articulated to pivot at the front toe of the shell and can be pivoted between an opening or insertion position and a closed position. In the closed position the two aforementioned shell parts are locked in place by spring-loaded catch pins on the stationary shell parts. The spring-loaded bolts can be brought into an unlocked position by cables in order to allow a release in case of excessive stress or an opening for stepping out. In the latter case, the skier can operate the cables by a lever housed on the stationary shell part. This is thus a shell binding which is intended to allow the use of very soft and therefore comfortable ski boots.

DE 2,556,817 A1 shows a ski binding with a binding plate that is attached by spring-loaded cables to the surface of the ski. When a release force is exceeded, this plate can be removed a distance preset by the length of the cables from the surface of the ski. A recess is provided for this plate in the sole of the ski boot. A catch mechanism is present in the interior of the plate and allows the locking of the plate in the recess of the ski boot sole. In case of a release of the binding due to excessive force, therefore, the boot is released from the ski together with the plate. For opening, that is, stepping out, the boot must be detached from the plate. An unlocking mechanism that can be operated by the skier either manually or with a ski pole is provided on the plate for this purpose.

Another so-called "step-in" binding, in which a skier need not operate any locking elements when stepping into the binding, is described in DE 4,106,401 A1. The boot is held by two ordinary stirrups, a front and a heel stirrup. The heel stirrup, however, is articulated to a tread element which is in turn attached so as to be able to pivot to connection elements that are tightly connected to the snowboard. Herein is also attached a locking mechanism which grips the tread element when it is pressed completely down and holds it locked in position. In order to open the binding the skier must bend down and operate this locking mechanism by hand in order to open it. If there is snow or ice beneath the shoe sole, a locking of the tread element is not assured, since this snow or ice would make contact with the binding, before the tread element was pushed all the way down. Thus this binding is only functional to a limited extent.

DE 2,511,332 A1 shows a ski binding in which part of the binding is likewise integrated into the heel of the ski boot. Two spring-loaded spherical-head bolts project laterally from the heel part of the boot sole and engage in matching recesses rigidly attached to the ski at the sides. This is a self-releasing safety binding which opens when a predetermined force is exceeded. This force is determined by the springs pushing the two bolts outward as well as by the shape of the spherical heads of these bolts and by the shape of the recesses for these spherical heads.

The regular opening of the binding is done at the front jaw holding the toe of the boot, while the heel attachment can only be overcome by tipping the foot to overcome the spring force. For emergencies in which the skier might be injured, it is also provided that the elements housing the bolts can be rotated so that a groove located in them allows the boot to be pulled up and out of the binding.

DE 2,200,056 A1 describes an additional release binding for skies. There too is provided a bolt pushed transversely through the boot sole; it engages with a hook-shaped, spring-loaded locking element. The entire locking element is pushed backward in the axial direction of the ski to open the binding; this is accomplished by operating a lever mounted on the ski.

DE 3,141,425 A1 shows a safety binding for skis in which spring-loaded pins are attached to the boot and matching receptacle devices are attached to the ski. Here too, a mechanism fastened to the ski is operated to open the binding.

Finally, DE 2,809,018 A1 shows a ski binding system consisting of ski boot and releasing binding elements, with a plate that projects beyond the boot incorporated into the sole or providing two bolts, somewhat separated, and pivoting hooks on the ski that grip laterally over this plate or the two bolts.

For snowboard bindings, many participants have long desired a so-called step-in binding, that is, a binding one could simply step into like a ski binding, without the snowboarder having to bend down to operate parts of the binding, such as locking stirrups. On the other hand, safety bindings that would permit complete release of the shoe from the snowboard in case of excessive force applied are still problematic for snowboards, since the resulting safety problems for participants and bystanders have not yet been satisfactorily solved, despite numerous proposals. Finally, the very serious problem of space also comes up in regard to snowboard bindings. The snowboarder is standing essentially transverse to the travel direction of the board, which means in practice that the angle between shoe longitudinal axis and snowboard longitudinal axis is between 45° and 90°, with some snowboarders even orienting their rear foot backwards, that is, at an angle of greater than 90° with respect to the direction of travel. Since snowboards, particularly the so-called alpine boards for snowboarders on prepared slopes, are becoming narrower and narrower, the toe of the boot and the heel of the ski boot are already projecting out over the contour of the snowboard. The principle can therefore be established that a snowboard binding must not project beyond the toe or heel of the boot, since this could lead to projecting binding parts touching the snow when the board is turned on edge. For this reason, conventional ski bindings that have the step-in function are not suitable for snowboards.

The initially mentioned step-in binding for snowboards, publicly announced at the ISPO fair in February 1994, avoids these disadvantages. Its comfort of use leaves something to be desired, however, since the snowboarder must bend over to open the binding in order to operate a release lever connected directly to the board's surface. The design of this release lever is also rather elaborate technically, and it tends to raise the weight. This runs contrary to the trend towards snowboards and snowboard bindings that are as light as possible.

SUMMARY OF THE INVENTION

It is an object of the invention, therefore, to provide an improved prior snowboard binding that increases the comfort of the binding and which meets the requirements for light weight, functional security and costs as low as possible.

Briefly, therefore, the invention is directed to a snowboard binding for releasably binding a snowboard boot to a snowboard for use by a snowboarder, the snowboard having an upper surface to which the snowboard boot is bound, the snowboard boot having an upper, a toe, a sole, and a heel attached to the sole. The snowboard binding has a first binding element to be firmly connected to the snowboard, a second binding element to be firmly connected to the snowboard boot and extending on both sides of the boot sole, the second binding element being lockable to the first binding element via a connection. The binding also has an unlocking device associated with the snowboard boot for loosening the connection between the two binding elements, the unlocking device being operable manually by an operating element associated with the snowboard boot.

Additional objects and features of the invention will be in part apparent and in part pointed out hereinafter.

BRIEF DESCRIPTION OF THE DRAWINGS

The invention is described on the basis of embodiment examples in conjunction with the drawings. These show.

Identical reference numerals in individual figures label identical or functionally corresponding parts.

DETAILED DESCRIPTION OF THE INVENTION

An aspect of the invention lies in moving essential parts of the binding and especially the locking device into the snowboard boots, which not only enhances comfort when stepping out of the binding, so that the snowboarder need no longer bend when stepping out of the binding, but also achieves the stated advantages. The binding parts to be fastened to the snowboard are light and insensitive to icing. The more expensive locking elements, also more subject to icing, are located inside the boot or boot sole and are therefore better protected against icing and can thus be combined with other snowboards that use the same binding parts. An aspect of the invention lies in the fact that not only stepping into but also stepping out of the binding is considerably eased, so that a so-called "step-out" function is achieved. Finally, it must also be emphasized that, after opening, the binding automatically returns to its initial position and is ready to be stepped into again without any active effort on the snowboarders part. This initial position is synonymous with the closed position, that is to say, the locking elements have the same rest position in a completely open and a completely closed binding. Thus it is impossible for the locking device to remain in a position, due to ice, perhaps, in which the binding might open inadvertently.

Figure 14:
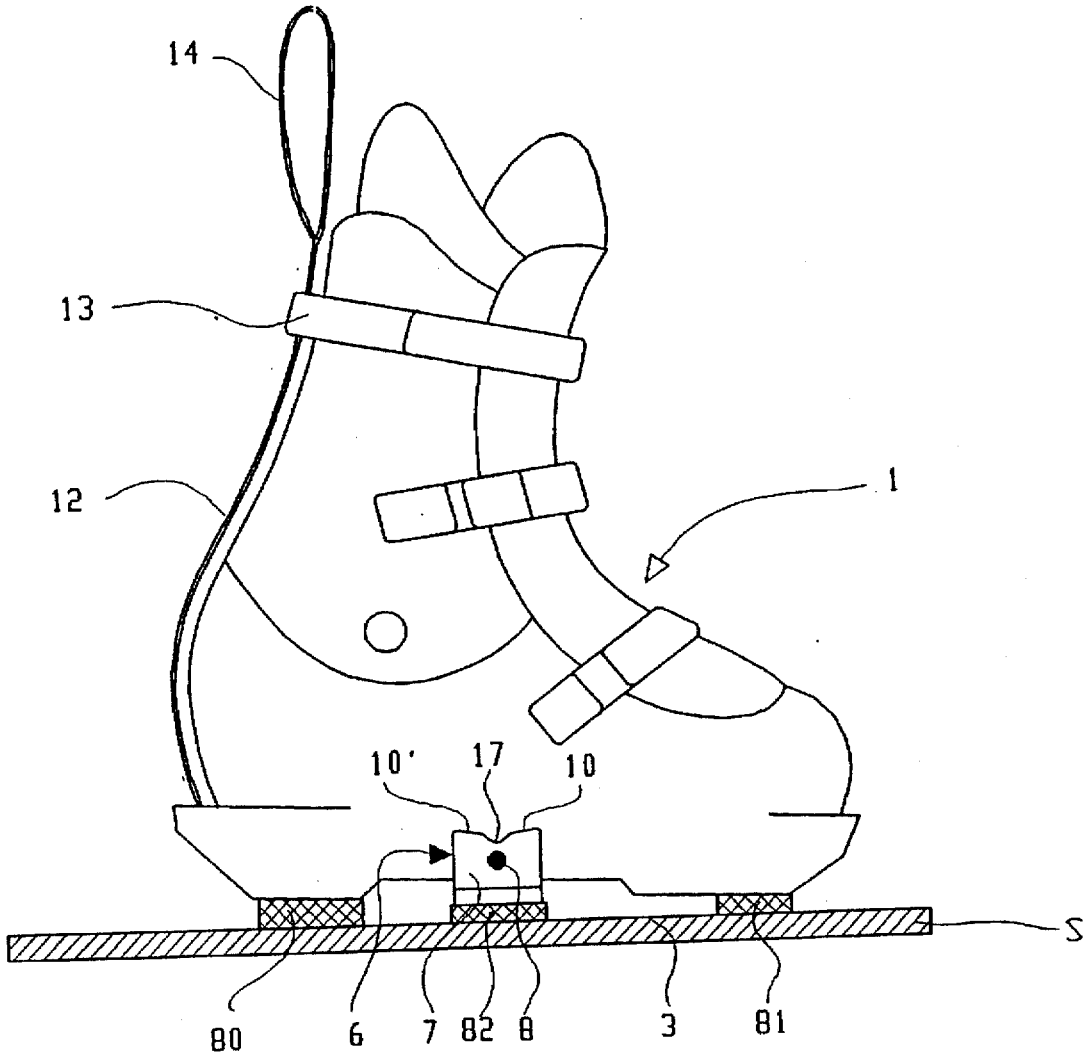
FIG. 14 a side view of the binding according to the invention in an additional variant.

Although the invention is described in most embodiment examples (except FIG. 7) in connection with the use of a front stirrup, it should be pointed out that in all embodiment examples the invention can also operate without such a front stirrup. In this case the shoe-side binding part, as described in greater detail in conjunction with FIG. 14, is mounted roughly in the middle of the shoe and it is assured with base blocks that the tip of the sole and the heel are positioned at the correct height with regard to the snowboard surface. In this case, it is also possible to omit a binding base plate. However, if it is desired that the fastening of the snowboard-side binding part to the snowboard should be more changeable, for instance, for adjusting the step size between the two bindings and/or the angle of rotation of the binding in regard to the longitudinal axis of the snowboard, then a base plate may be used in this variant as well.

Figure 1:
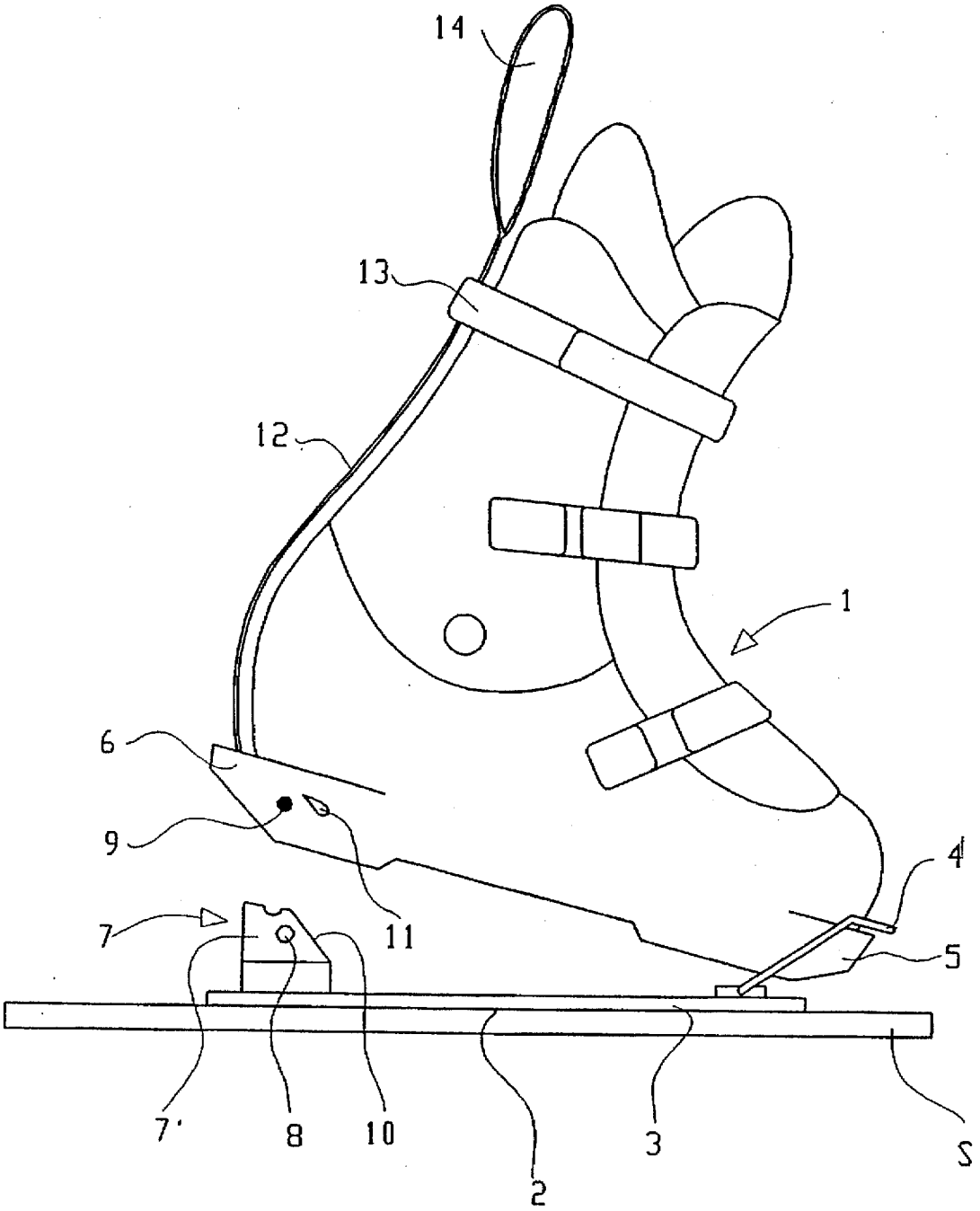
FIG. 1 a schematic side view of a first embodiment example of the snowboard binding and a snowboard boot with a not yet closed binding.

FIG. 1 shows a side view of a snowboard boot 1 just prior to its locked position with a binding element 2 to be fastened to the snowboard 5. This binding element 2 consists of a base plate 3 to be fastened to the snowboard, which can be done in a variety of ways. As is common with so-called plate bindings, the binding element has a front stirrup 4 which grips over a sole projection 5 of the snowboard boot 1 and thus holds the front end of the snowboard boot in place. A second binding element 6, configured here as the heel part 6 of the snowboard boot 1, contains essential parts of the binding that cooperate with a heel element 7 mounted on the binding element 2.

In a rough sketch, this heel element 7 has two parallel lateral cheeks 7',7", the spacing of which is only slightly greater than the width of the heel part 6 of the snowboard boot 1. Each lateral cheek 7',7" has an opening 8 into which a spring-loaded pin 9 projecting laterally out of the heel part 6 can engage respectively.

For the secure fastening of the snowboard boot it is necessary that it be pressed forward with a minimal force against the front stirrup 4. This therefore implies that the spacing between the front stirrup 4 and the pin 9 or the opening 8 which houses it has a certain maximum length in order to produce this force. When stepping into the binding the boot is normally pushed against the front stirrup 4 with a lowered front foot and a somewhat elevated heel, which does not produce sufficient pressing force, however. Then the pins 9 and openings 8 would not be sufficiently aligned when the heel goes down. In order to achieve this alignment, a downward incline 10 is provided on each of the lateral cheeks 7',7". The two inclines cooperate with laterally protruding projections 11 and press the boot as a whole forward when the heel is pressed down. The spacing between the pin 9 and the projection 11 corresponds exactly to the spacing between the opening 8 and the slope 10, so that as the heel is pressed down, the spring-loaded pin 9 is certainly guided past the opening 8 and then can engage in it. At the same time, the necessary force pushing the boot forward is produced, which presses the boot toe firmly against the front stirrup 4.

When the pins 9 are engaged in the openings 8, the boot is firmly attached to the snowboard and can no longer come loose inadvertently. To open the binding, the two pins 9 are pressed or drawn together inwardly in this embodiment example, so that they come loose from the openings 8, which means that the shoe can initially be raised somewhat by the heel and then removed from the binding. In order to displace the pins 9 in the manner described, a cable 12 is provided, which is led upward on the back side of the boot 1 to the shaft and held in place there by a belt 13. A grip loop 14 is placed on the cable 12. If the cable 12 is pulled, then, as will become clearer in the description below, the two pins 9 are pulled inward, which opens the binding.

A peculiarity of the invention is therefore the fact that the opening or unlocking of the binding is done on the boot and not on the part of the binding that is fastened to the snowboard or ski, as in previously known snowboard or ski bindings. This has the advantage, among others, that the snowboarder need not bend down to the binding or use ski poles (not present in snowboarding anyway) for assistance, as is the case with most ski bindings. If desired, the snowboarder can extend the length of the cables indefinitely, perhaps even up to belt height. An additional advantage is that essential components of the binding are integrated into the boot. Thus the binding element 2 which is constantly connected to the snowboard can be designed to be very simple and very economical, so that a snowboarder who owns several snowboards need only buy the more expensive binding parts once, together with the boot, whereas only the more economical binding element 2 need be purchased for all snowboards. To achieve these and other advantages, the unlocking device for loosening the connection between the two binding elements is associated with the boot, in particular, it is on or in the boot. Furthermore, the unlocking device is operable manually by an operating element which is associated with the boot, in particular, which is on or in the boot. This aspect of the invention is present in connection with each of the various embodiments.

It should also be emphasized that the heel part 6, which contains essential components of the binding, can also be manufactured as a separate part and subsequently screwed or glued on onto a boot or fastened in some other manner.

Figure 2:
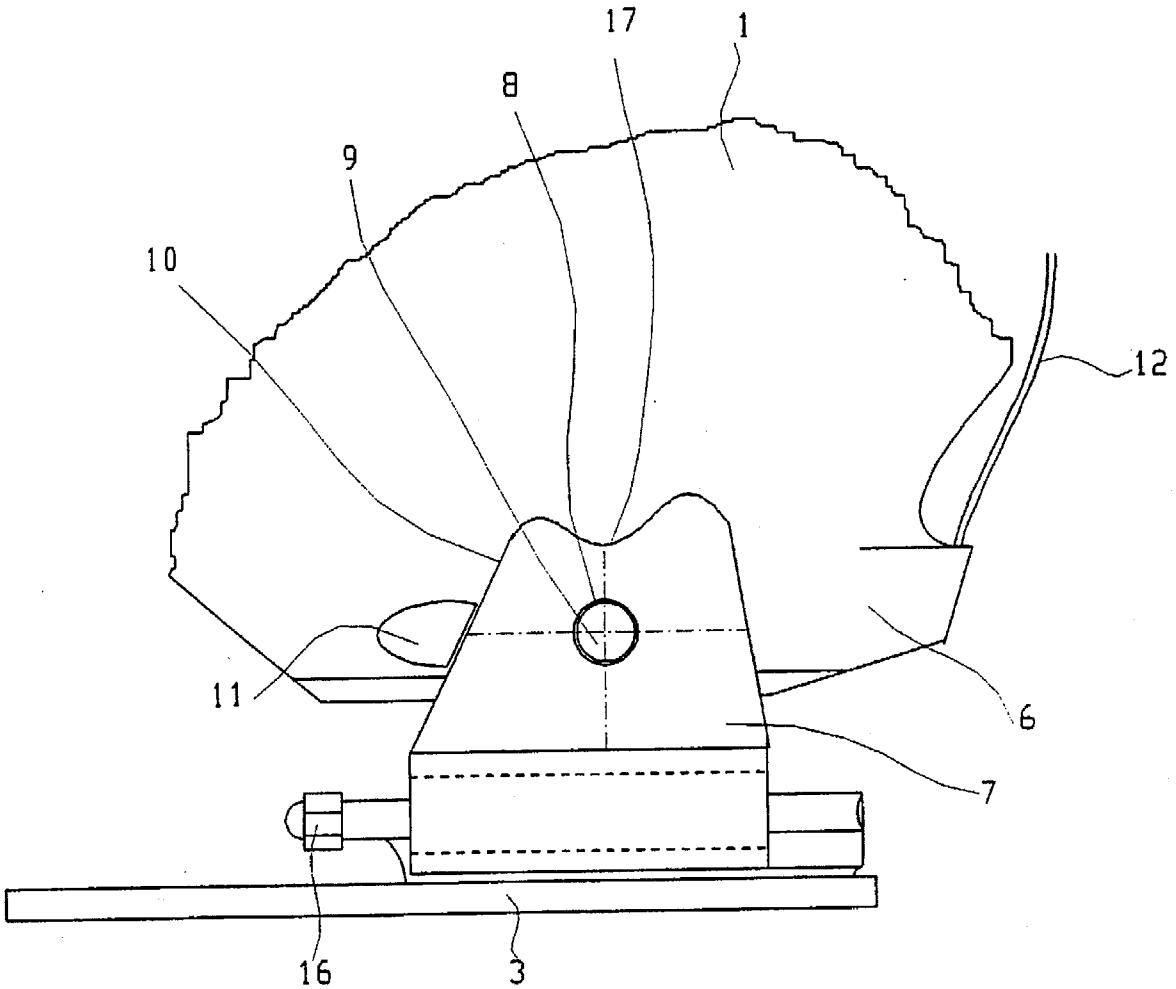
FIG. 2 a side view of a heel part of the snowboard binding according to FIG. 1 in the mounted stated.

FIG. 2 shows a side view of heel-side components of the binding in the locked state, that is, in which the pin 9 is engaged with the opening 8. Also clearly seen here is the effect of the incline 10 and the projection 11, which cooperate to guide the boot while the heel is being pressed down such that the pin 9 and the opening 8 are oriented towards one another. It is recognized better from FIG. 2 that the lateral cheek 7 is guided so it can be displaced on a mounting block 15 attached to the base plate 3, which means that the binding as a whole can be matched to the shoe size. A setscrew 16 is provided for displacing the lateral cheeks.

The lateral cheeks have a dimple 17 at their upper end, which makes stepping into the binding easier, because with light pressure applied to the heel, the pin 9 moves to the lowest point of the dimple 17, which means that the projection 11 is then in the proper position with respect to the incline 10. It is also clearly recognizable from FIG. 2 that the lower side of the shoe sole of the heel part is not yet in contact with any binding elements such as the mounting block 15, but instead maintains a distance from it. Thus a secure locking of the binding occurs even if there is snow underneath the boot sole. Since the heel is supposed to be somewhat higher than the toe of the boot for snowboards anyway, with the invention one can dispense with the wedge underlay otherwise used for the heel part.

Figure 3:
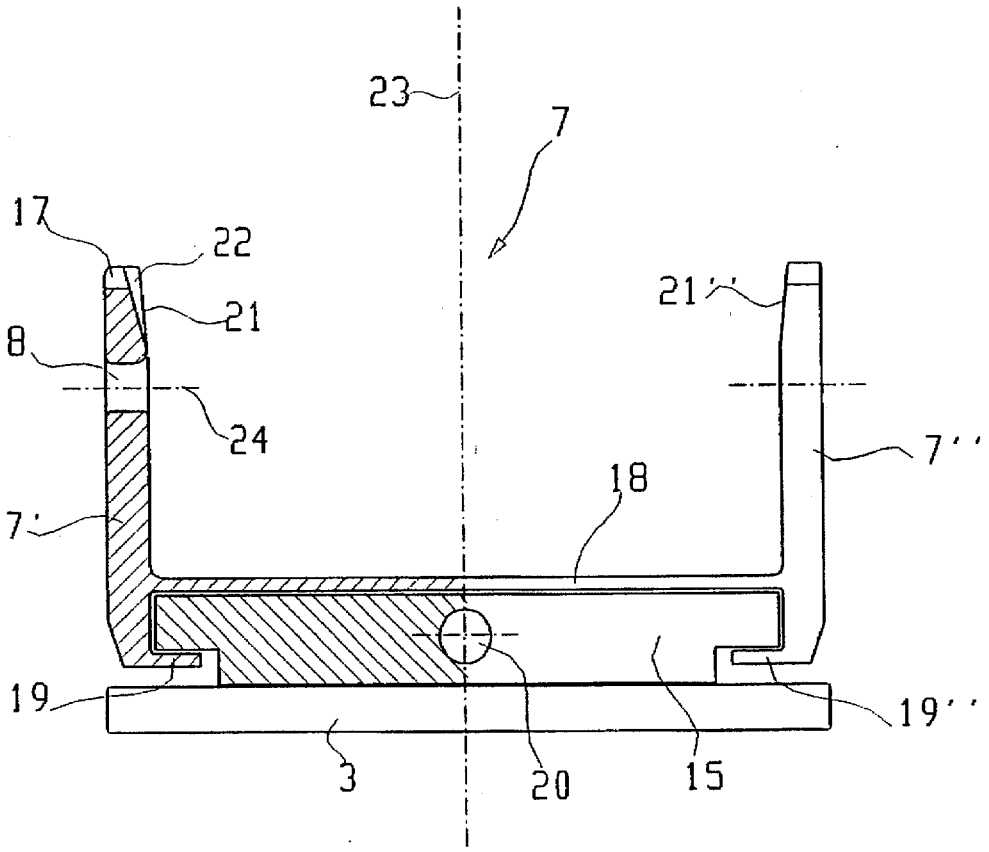
FIG. 3 a partial sectional top view of the part of the binding to be fastened to the snowboard.

Clearly recognizable in FIG. 3 is the position of the two lateral cheeks 7',7", which stick out vertically from the snowboard parallel to one another and house the heel part of the snowboard boot between them. Both lateral cheeks 7',7" are connected together by a connection element 18 that lies on the mounting block 15. Both lateral cheeks 7',7" are extended in the direction of the base plate 3 beyond the connection element 18 and grip over the mounting block 15 with inward-directed arms 19',19". Thus the heel element 7 is firmly on the mounting block 15 and can be displaced only in the longitudinal direction of the snowboard. For this purpose, the mounting block 15 has an opening 20 for housing the setscrew 16 as well as a slot, not illustrated, which opens the opening 20 to the upper side of the mounting block 15, so that a threaded part (not shown) connected to the connection element 18 is in connection with the setscrew 16, with which a longitudinal adjustment of the heel element 7 is possible.

It is also easily recognizable from FIG. 3 that the lateral cheeks 7',7" have an incline 21',21", respectively, above the openings 8 which insures that the spring-loaded pin is pressed inward into the heel part 6 of the shoe.

Figure 3A:
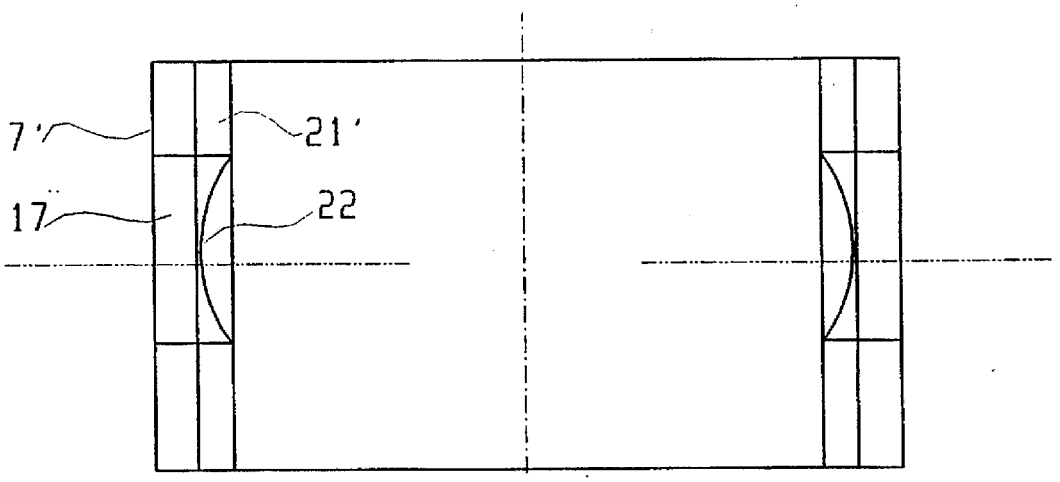
FIG. 3A a plan view of FIG. 3.

In order to design the effect of the dimple 17 to be more efficient, it is practical to insure that the bolts 9 are only pressed inward in the position in which they make contact with their cylindrical part on the upper side of the lateral cheeks. For this purpose an additional dimple 22 running parallel to the longitudinal extension of the inclines 7',7" is provided in the vicinity of the inclines 21',21". The dimple is best recognized from FIG. 3*a* and has a greater angle of inclination with respect to a central axis 23 perpendicular to the snowboard than the incline 21'. Only when the bolt 9 is in the deepest point of the dimple 17 does its free end make contact with the wall of the dimple 22, so that it is pressed inward when the heel is pressed downward.

It is also recognizable from FIG. 3 that the central axis 24 of the openings 8 is spaced away from the upper side of the connection element 18, with this spacing being greater than the corresponding spacing between the midpoint of the pin 8 and the bottom side of the sole of the heel part 6 of the snowboard boot 1. In that way the functioning of the binding is not impaired by snow or ice on the sole of the snowboard boot.

Figure 4:
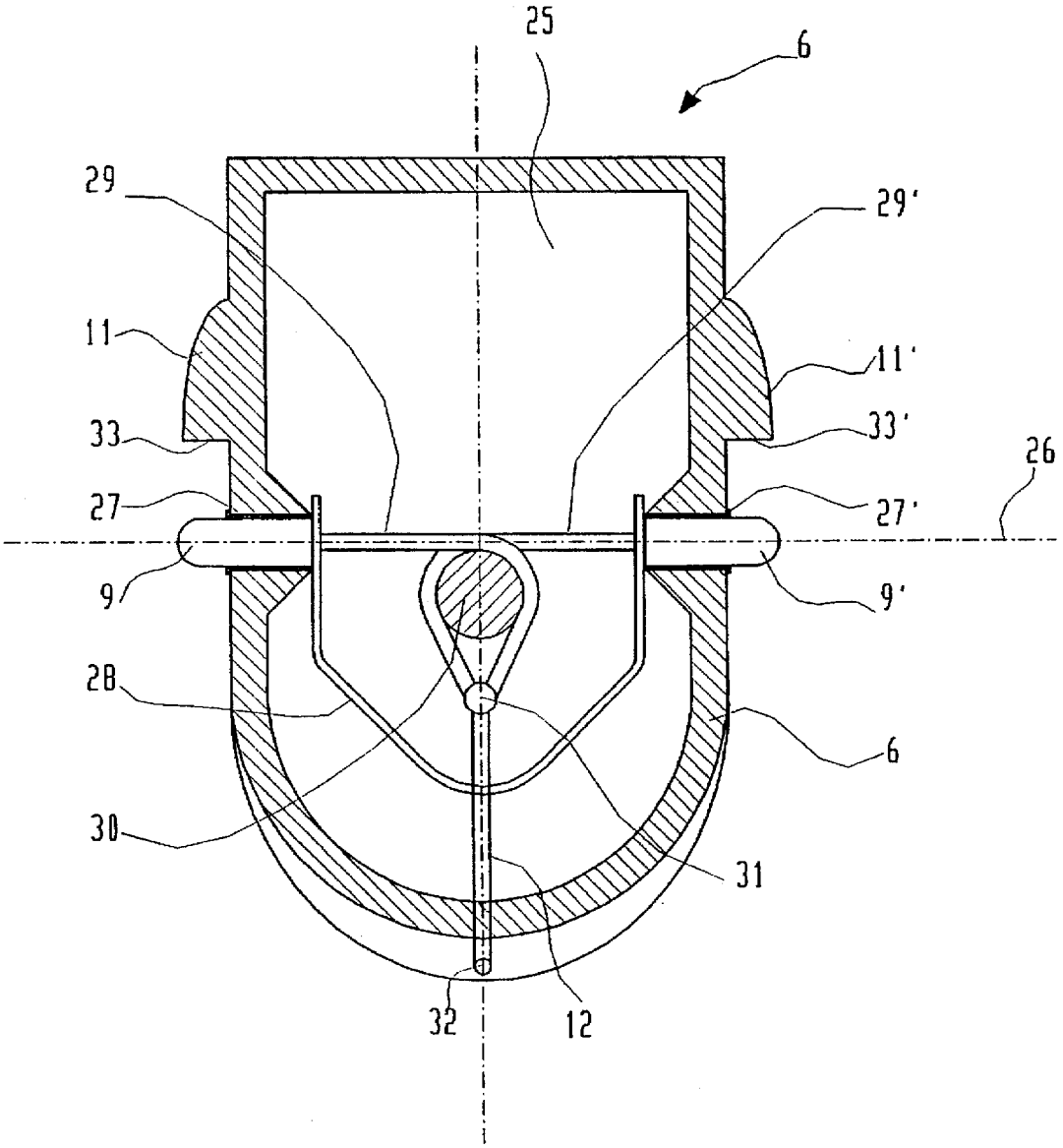
FIG. 4 a sectional plan view of the components of the snowboard binding located in the heel part of the snowboard boot according to FIG. 4.

FIG. 4 shows a plan view of the inside of the heel part 6 of the snowboard boot 1. This heel part has a cavity 25 in which the pins 9,9' and the mechanism for displacing them are accommodated. Along an axis 26 that coincides with the axis 24 of FIG. 3, the heel part 6 has two opposing aligned openings in which the guide bushings 27,27' are inset and in which the pins 9,9' respectively are guided so as to be displaceable. Both pins are pressed outward by a spring 28, until here in the embodiment example of FIG. 4 the pins 9,9', directly connected at their inside end faces by the spring 28, abut against a stop formed here by the guide bushings 27.

The spring 28 is constituted here as a U-shaped stirrup. The length of the pins 9,9' is dimensioned such that the pins 9,9' only protrude laterally by a predetermined amount, for instance 5–10 mm, from the contour of the heel part 6. The ends of the pins 9,9' protruding outward are rounded off in order to ease the insertion of the pins between the two lateral cheeks 7',7". The radius of curvature of this rounding is equal to half the diameter of the otherwise cylindrical pins, so that the points of the pins protruding outward form a hemisphere.

A tensile element 29,29', which may be a plastic or metal cable in the simplest example, is formed on the pins 9,9', respectively, in order to open the binding. These two tensile organs are guided in opposite directions over a deflection stanchion 30 and connected together in a connection element 31, as well as to the cord 12 which is guided through an opening 30 from the inside of the heel part 6, as illustrated in detail in FIG. 1. The cable 12 can also be made of plastic or metal. If one pulls on this cable 12, the tensile force will be directed onto both tensile elements 29,29' and transferred by way of the deflection stanchion 30 to the pins 9,9' so that the latter are drawn inward along the axis 26 into the heel part 6. If the cable 12 is once again released, the two pin are pushed outward again by the spring 28.

It can also be easily recognized from FIG. 4 that the projections 11,11' stick out roughly just as far as the pins 9,9' from the contour of the heel part 6, which shield the pins 9,9' so that the danger of being caught on the pins in ordinary walking is reduced. To this end, the projections 11,11' also have a rounded off shape, an elliptical shape for instance, and thus act as guards to prevent the pins 9,9' from catching on any objects. The surfaces 33,33' of the projections 9,9' immediately facing the pins 9,9' are shaped essentially smooth and are fitted to the incline 10 (FIG. 1).

Finally, it is also recognizable in FIG. 4 that the heel part 6 is closed off all around and thus can be employed as an aftermarket product for conventional snowboard boots. Naturally it is also possible to integrate the heel part 6 completely into the shell of the snowboard boot.

Figure 5:
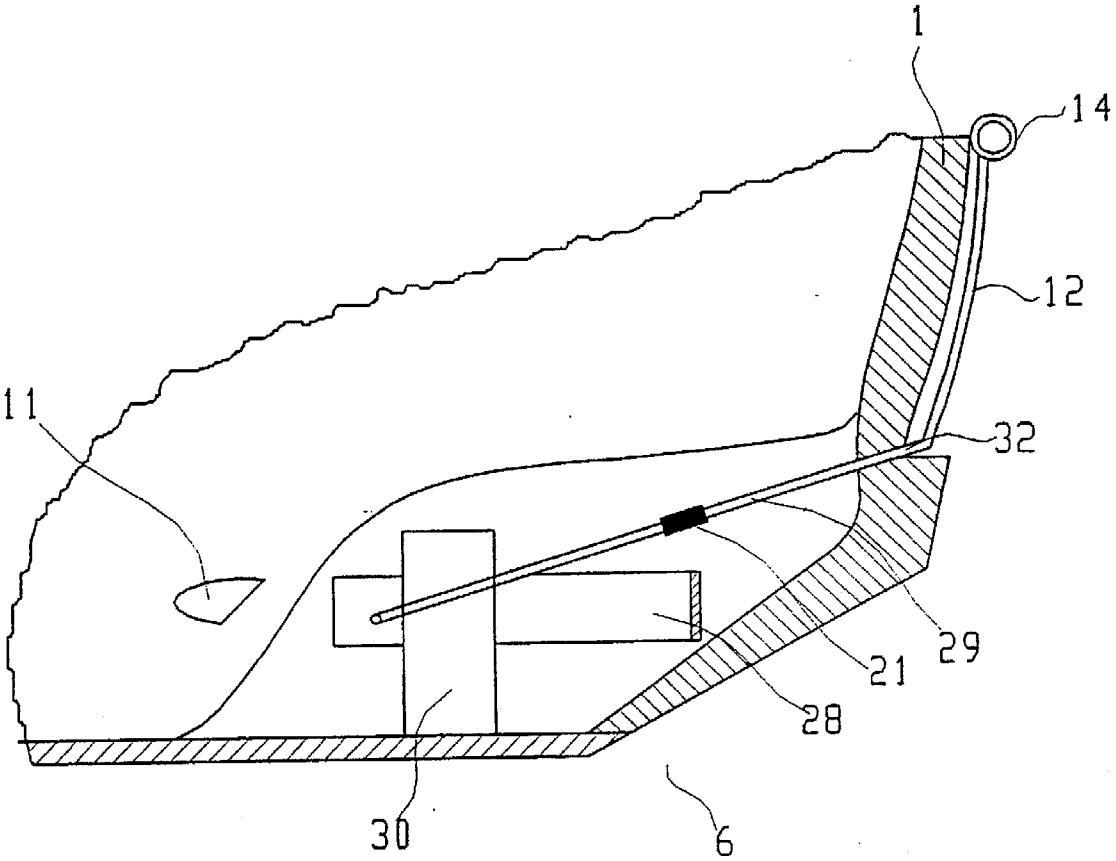
FIG. 5 a partial sectional side view of the heel part of the embodiment example according to FIG. 4.

The side view in FIG. 5 clarifies the position of the spring 28, the tensile element 29 and the cable 12 in the heel part 6 of the snowboard boot 1. The deflection stanchion 30 can be provided as a separate part, but it can also be molded in one piece with the heel part, which generally consists of plastic.

Figure 6:
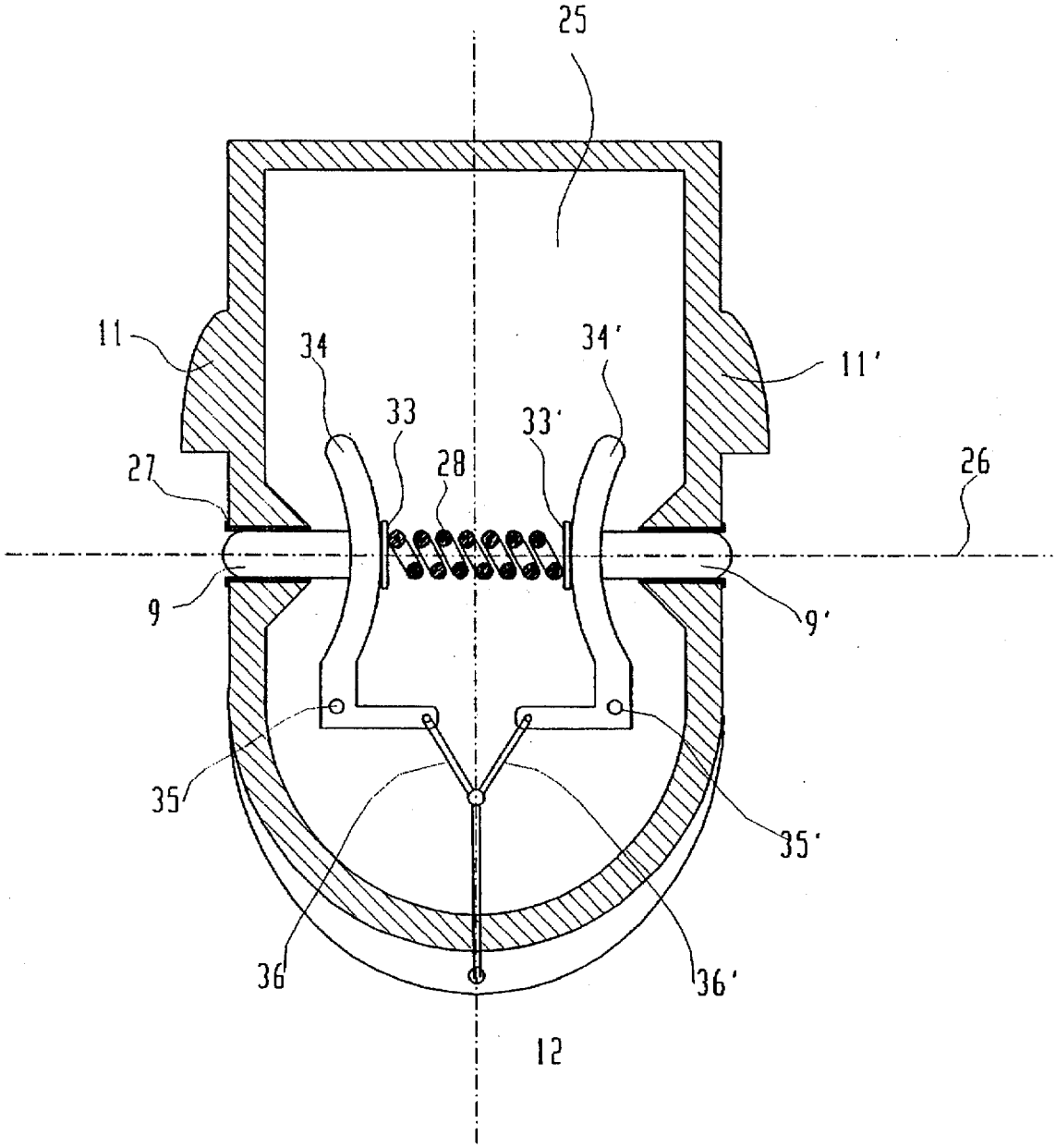
FIG. 6 a view similar to FIG. 4 for a second embodiment example of the invention.

FIG. 6 shows another variant of the heel part, differing from the embodiment example of FIGS. 4 and 5 by the spring and the tensile elements. The spring 28 is constructed here as a coil spring oriented along the axis 26 and pressing against the two pins 9,9'. The two pins 9,9' each have an enlargement 33, 33' respectively at their ends, on which the spring 28 is supported and each of which also supports one arm of a lever 34,34' on the side of the enlargement 33 opposite the spring 28. This can be done on one side of the pin. The corresponding lever arms can also be constructed as claws that grip the pin on both sides. These arms are bent in a convex shape in order to slide along the enlargement 33 during pivoting of the levers about pivot axis 35,35' respectively. The two other arms of the lever 34,34' are roughly perpendicular to the aforementioned arms and are connected via two short cables 36,36' to cable 12. In the illustration of FIG. 6, the cable 12 is being pulled, so that the two pins 9,9' are roughly in the unlocked position. In the locked position, the two pins 9,9' abut against guide bushings 27,27', which in turn define the limit position of the pins 9,9'.

Figure 7:
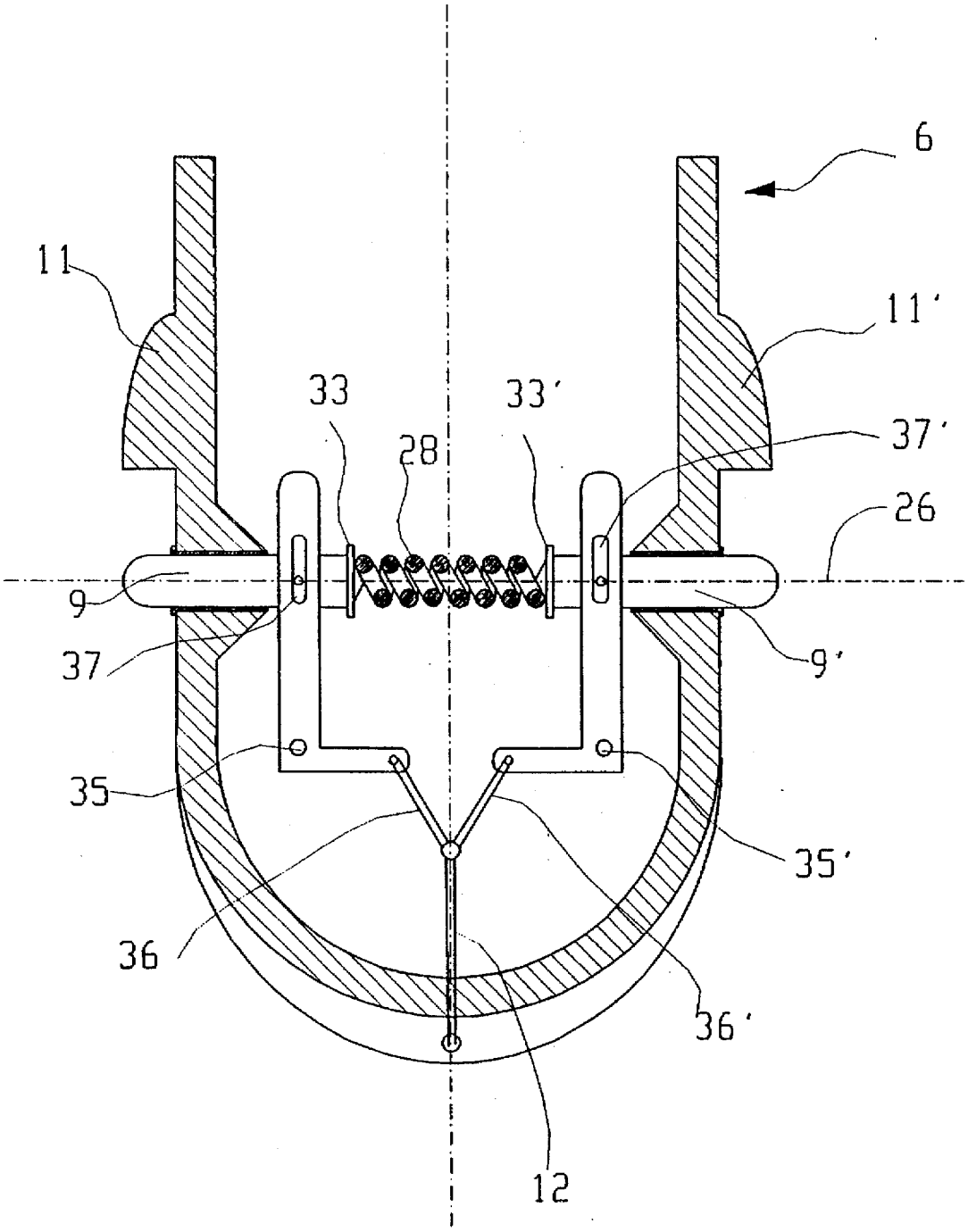
FIG. 7 a view similar to FIG. 4 for a third embodiment example of the invention.

The variant in FIG. 7 likewise works with a coil spring 28 and levers 34,34'. It is distinguished from the embodiment example of FIG. 6 by the shape of the levers and their attachment to the pins 9,9'. The levers 34,34' are connected to the pin here by a slot connection, that is, the levers 34, 34' each have a slot 37,37', into which a bolt 37' running perpendicular to the axis 26 of pins 9' is inserted. When the levers are pivoted, this bolt 37' slides along the slot 37. Otherwise, the functioning corresponds to the embodiment example of FIG. 6.

Figure 8:
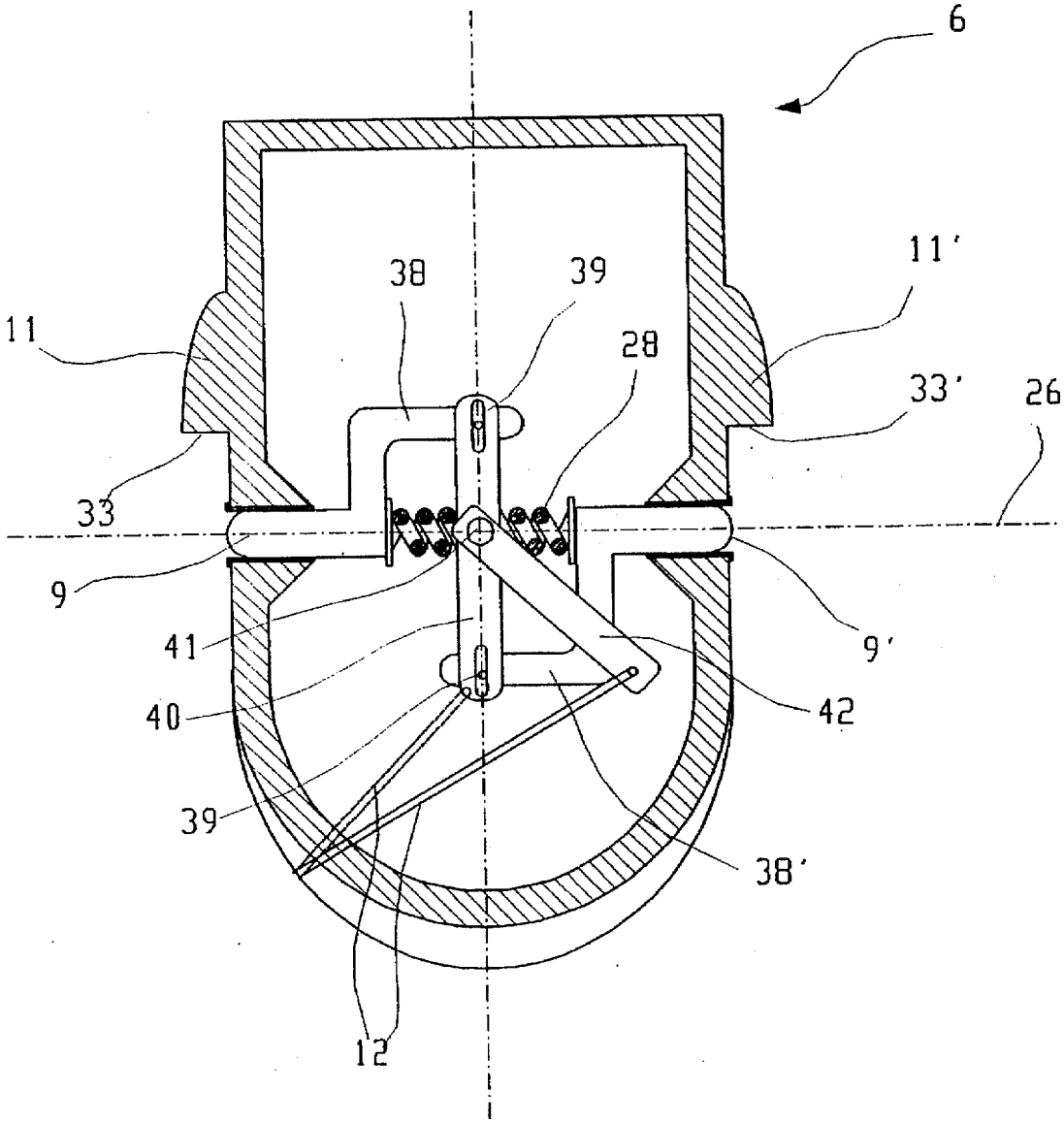
FIG. 8 a view similar to FIG. 4 for a fourth embodiment example of the invention.

The embodiment example of FIG. 8 likewise operates with a coil spring 28 and a rod linkage, which as a result the desired tensile force is exerted on the pins 9,9'. The pins 9,9' are bent so that the bent arms 38,38' are offset with respect to the axis 26. The free ends of these bent arms 38,38' are connected by slot connections 39,39' to a pivoting lever 40, the pivot axis of which is positioned mirror-symmetrically to the two pins 9,9' on the axis 26. The cable 12 can either be articulated at one end of the pivoting lever 40 or, depending on the desired exit point for the cable 12, to an additional pivoting lever 42, which is firmly connected to the pivoting lever 40 and thus transfers the tensile force of the cable 12 to the latter.

Figure 9:
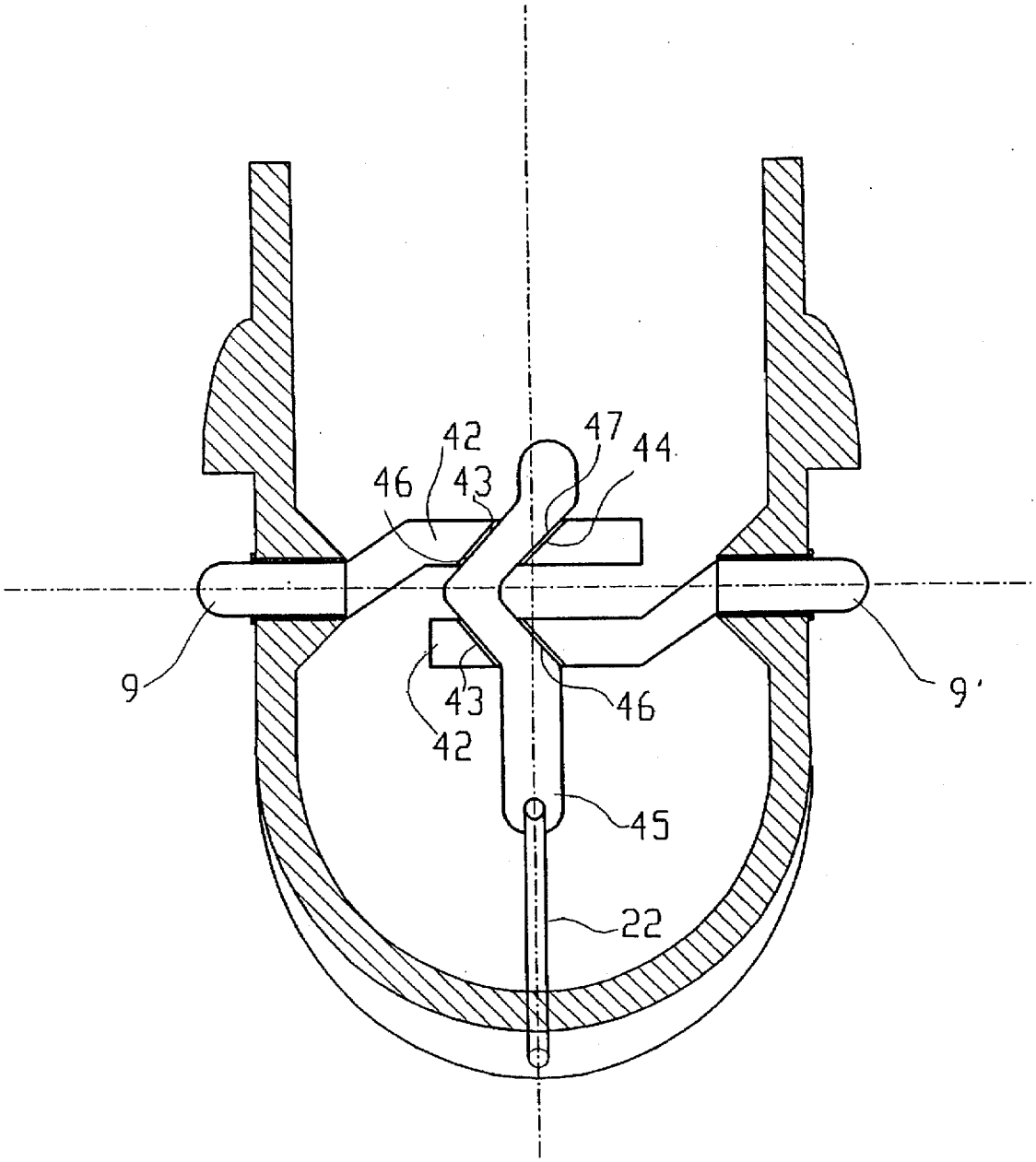
FIG. 9 a view similar to FIG. 4 for a fifth embodiment example of the invention.

In the embodiment example of FIG. 9, sections of the pins located in the interior of the second binding part 6 are mutually laterally offset and here are pressed outward by a spring (not shown). The mutually overlapping part 42 of the pins has passage openings 43 with inclined sides 44. Inserted into these passage openings is a bolt 45 which has oppositely oriented ramp inclines 46,47. If the bolt 45 connected to cable 22 is displaced, then the two pins 9,9' are drawn inward, which opens the binding. The spring with a force tending to press the two pins 9,9' outward can be embodied in a great variety of ways. It may, for instance, attach directly at the bolt 45 as an extension of the central axis and be constructed as a compression or tension spring. It may also be designed as a strap spring, corresponding to the embodiment example of FIG. 4. Finally, it is also possible to provide one or two compression springs that act directly on the pins.

Figure 10A:
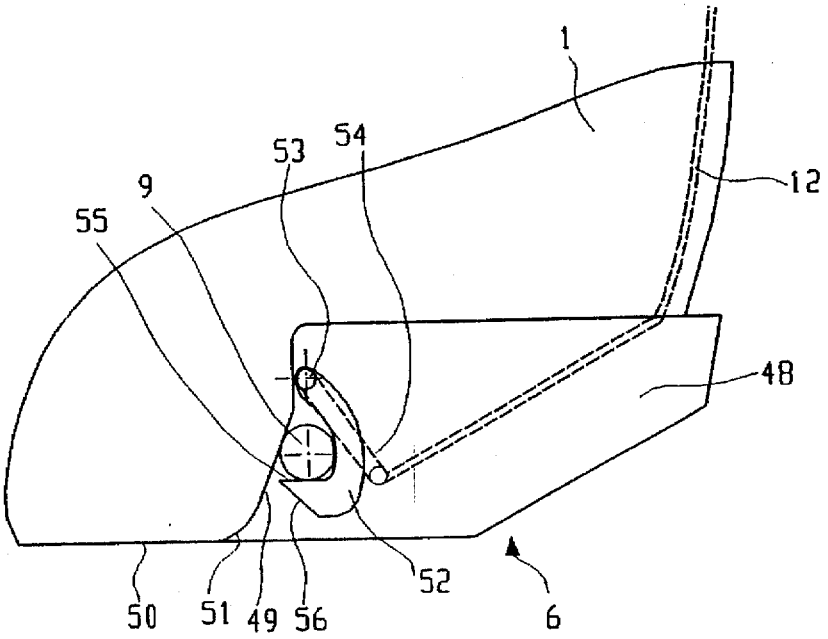
FIG. 10A a side view of a snowboard boot according to a sixth embodiment example of the invention.
Figure 10B:
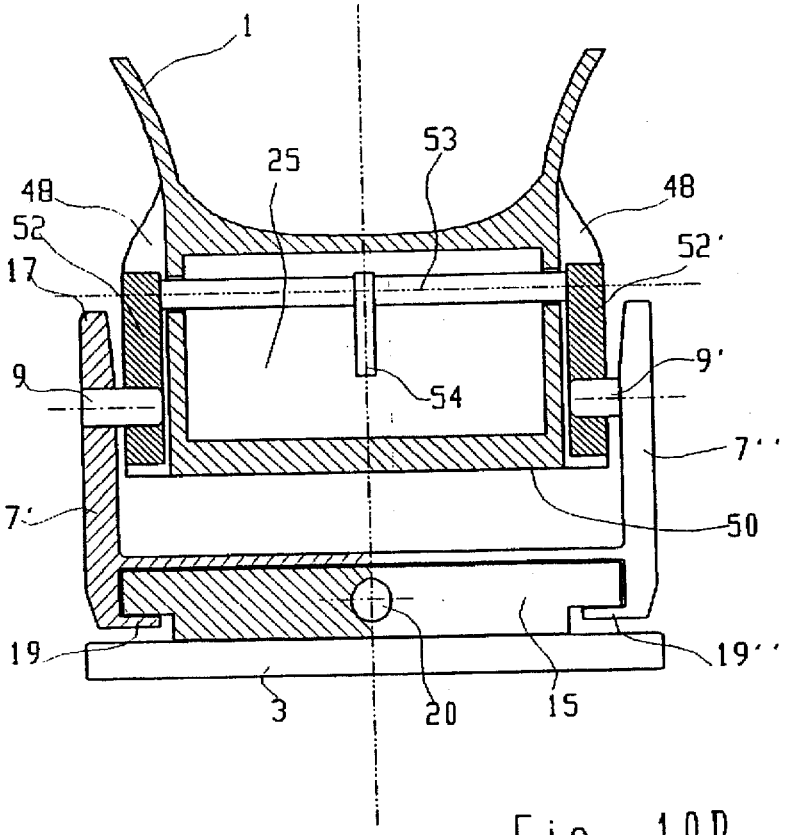
FIG. 10B a cross section through the boot and a partial cross section of the related binding element of the embodiment example of FIG. 10A.
Figure 11A:
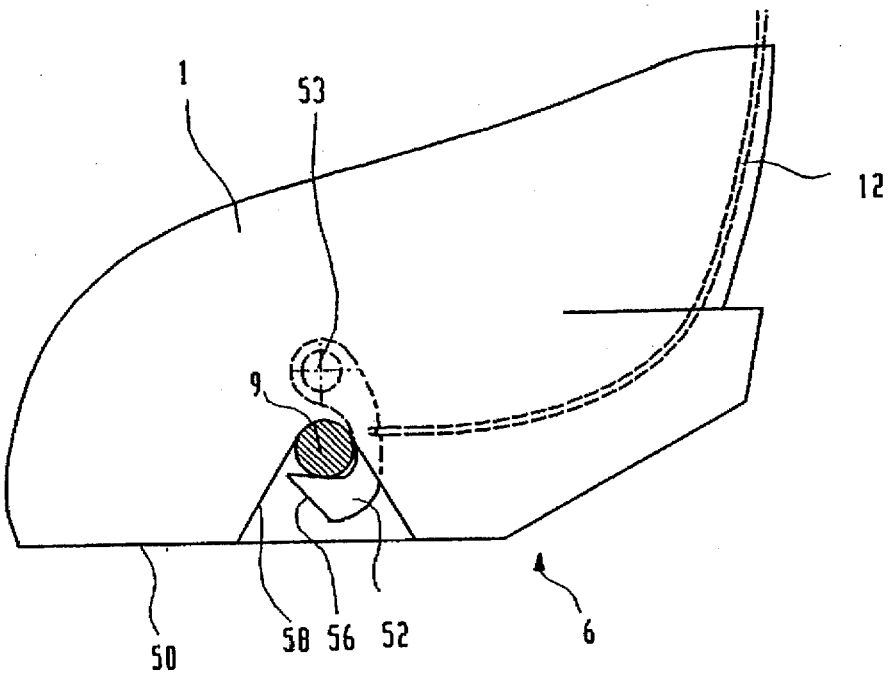
FIG. 11A a side view of the heel part of a snowboard boot according to a seventh embodiment example.
Figure 11B:
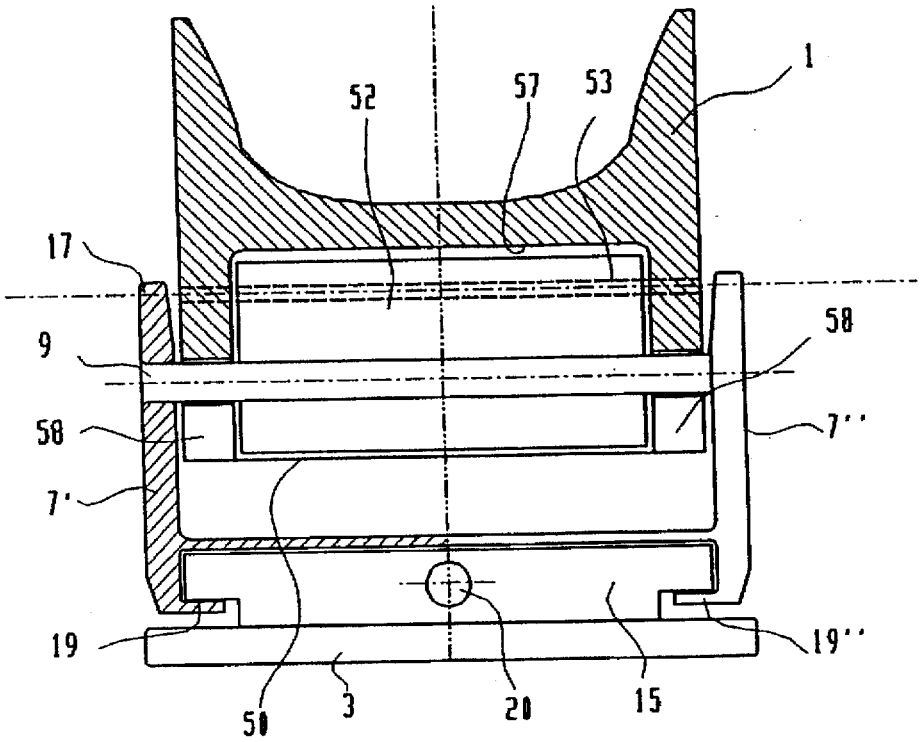
FIG. 11B a cross section through the heel part of the boot and a partial cross section of the matching binding element to be fastened rigidly to the snowboard in the embodiment example of FIG. 11A.

In the embodiment example of FIGS. 10 and 11, one or two pins are attached to the lateral cheeks 7',7", while the locking mechanism has the form of one or two pivoting levers which grip behind the pin or pins.

FIG. 10A shows a side view of the heel part 6 of a snowboard boot 1. In the rear sole area, a recess 48 extending inward on both sides, has an inclination 49 in the area pointing towards the sole tip, which ends in a rounding 51 near the lower side 50 of the sole. A locking lever 52,52' is housed in each of these two cutouts 48, both locking levers 52,52' being fastened to a common rotating shaft 53. This rotating shaft runs crosswise through the snowboard boot through the cavity 25. Another lever 54, connected to the cable 12, is attached without rotational play to the rotating shaft 53. Furthermore, a spring, not shown, can be attached to this lever 54 to press the lever 54 and thus the two locking levers 52,52' opposite the tension direction of the cable 12 in the direction of the shoe toe, thus pressing the two locking levers into their locked position. The locking levers 52 are bent in a bow shape and have a flat locking surface 55, which is oriented roughly horizontally in the locked position and firmly contacts the associated pins 9,9' placed on the lateral cheeks 7',7". Adjacent to this locking surface 55, the locking lever 52 has an inclined plane 56, which insures during the stepping-in process that the locking levers 52,52' are pivoted backwards into the opening position as soon as the inclined plane 56 touches the pins 9. As soon as the tip of the locking levers slides past the pin 9, the locking levers 52 are pressed forward by spring force into the locking position, and the binding is closed.

When stepping into the binding, the incline 49 serves as a guide surface which, as soon as it makes contact with the pin 9, displaces the boot forwards. It thus has essentially the same function as the projection 11 with the guide surfaces 33 in the previously described embodiment examples.

The locking levers are well protected in the recesses 48, so that there is no danger that these levers will get caught somewhere during the stepping-in process.

It can be seen even better from FIG. 10B how the two pins 9,9' are fastened to the lateral cheeks 7',7" and point inward at one another. The recess 48 and its protective function for the locking levers 52,52' are also clearly recognizable.

In connection with FIG. 10A, it should also be pointed out that even in the inside of the boot, the cable 12 can be directed upwards into the boot, running, for instance, between shoe liner and shell. This arrangement is a fundamental possibility with all embodiment examples.

In order for the locking position of the locking levers to be securely fixed in place and not dependent on the force of the spring, it is practical to arrange the central axis of the of the rotating shaft 53 above the central axis of the pins 9 with the binding closed or even to displace it somewhat towards the boot toe. Forces directed perpendicularly upwards from the snowboard surface would then in the first instance not exert any torque onto the locking levers 52 or, in the case of an axis of the rotating shaft 53 displaced even further forward, would even produce a torque forcing the locking levers 52 more firmly into the locking position.

In the embodiment example of FIG. 11, a pin 9, passing all the way through and connecting the two lateral cheeks 7',7" and only one central locking lever 52, which has the same cross section in the side view of FIG. 11A as the two locking levers 52,52' of FIG. 10, are used. The boot sole has a recess 57 opening downwards and ending laterally (FIG. 11A) in an opening which in turn has an incline 58 on its wall pointing towards the boot toe and, in cooperation with the pin 9, forcing the boot forwards towards the toe. Here too the central locking lever is pressed by a spring, not shown, into the locking position. Otherwise the function is the same as in the embodiment example of FIG. 10.

Figure 12:
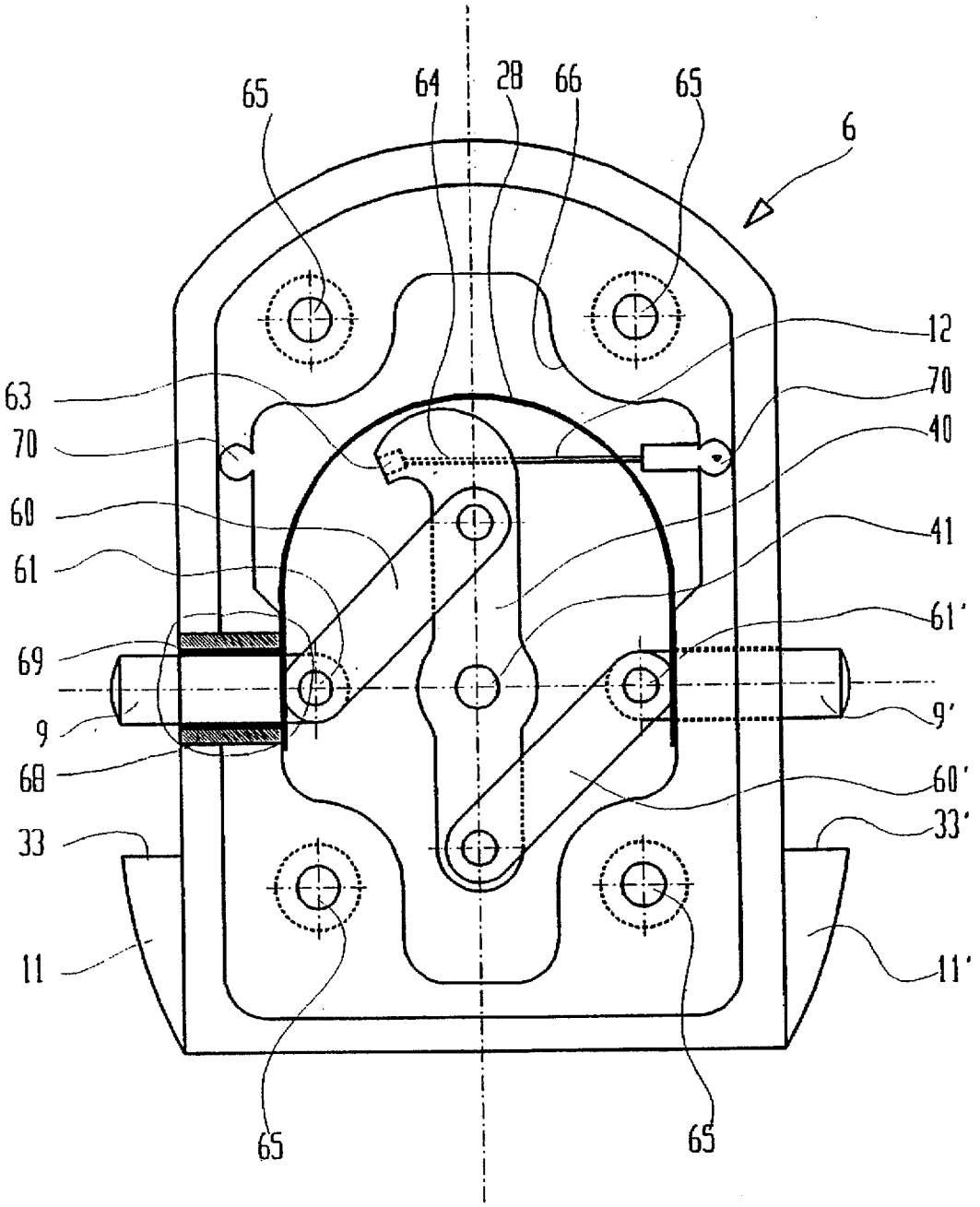
FIG. 12 a sectional plan view similar to FIG. 4 of a seventh embodiment example of the invention.

In the embodiment example of FIG. 12, the pins 9 located in the interior of the second binding part 6 are connected by articulated levers 60,60' to the pivoting lever 40, with the ends of the articulated lever 60,60' each being connected by a pivot joint to the pins 9,9' and the pivoting lever 40. The central axis of the pivoting lever 40 runs perpendicular to the central axis of the pins 9,9'. One central axis of the articulated lever 60,60', by contrast, is positioned at an angle of roughly 45° to the central axis of the pivoting lever 40. The two pivoting levers 60,60' are parallel to one another and are each connected to one end of the pivoting lever 40. If the pivoting lever 40 is rotated about its pivot axis 41 (clockwise in FIG. 12), then the articulated levers 60,60' each apply a tensile force to the pins 9,9' and pull them into the interior of the second binding part 6. The tensile element 12 is connected to one end of the pivoting lever 40. For this purpose, a blind hole 63 and a continuing smaller through-hole 64 are provided on the pivoting lever. The tensile element 12 is threaded through the through-hole 64 and thickened at its end by a knot, a press-on sleeve or the like so that it can no longer be pulled back through the through-hole 64. The thickened end is then arranged to be sunk into the blind hole 63.

In contrast to the previously described embodiment examples, the tensile element 12 runs in the interior of the second binding part 6 roughly at a right angle to the central longitudinal axis of the shoe and is therefore directed outward laterally on the boot.

The second binding part 6 is constructed as an injection-molded plastic part, as was possible in principle for the other embodiment examples as well, and can be subsequently screwed onto the sole of a boot. Screw holes 65 are provided for this purpose. In order to be able to accommodate binding parts in this binding element 6, a recess 66 is provided and houses the individual parts, including the spring 28. This spring is constructed here as a leaf spring bent in a U-shape, supported on the ends of the pins 9,9' projecting into the interior of the binding part, as becomes clearer from the detailed view in FIG. 12*a*.

It can also be recognized in FIG. 12 that the second binding part 6 has drill holes 70 on both sides through which the tensile element 12 can be led out, since it is fundamentally desirable to lead the tensile element to the outside of the respective boot, that is on the right side of the right boot and on the left side of the left boot.

Figure 12A:
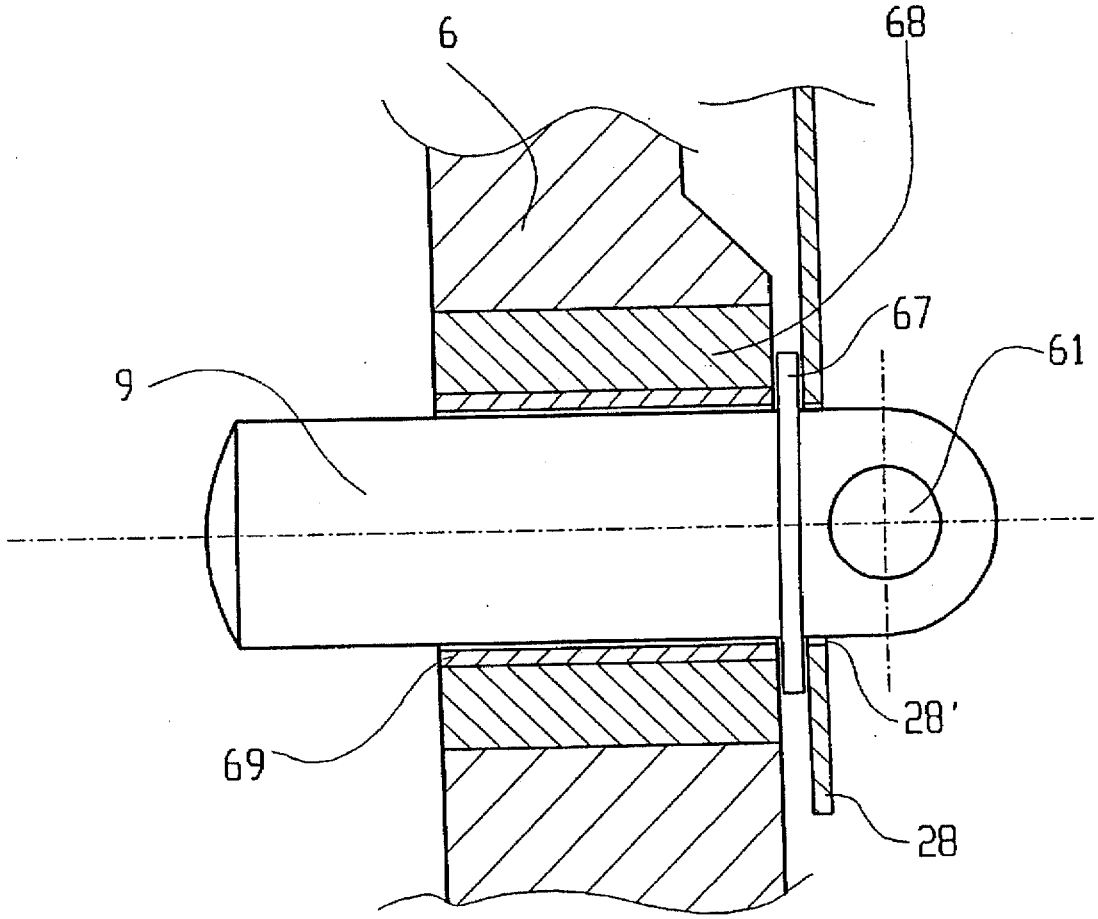
FIG. 12*a* an enlarged detail view of a specific aspect of FIG. 12.

FIG. 12*a* shows an enlarged detail view of a specific aspect of FIG. 12, namely, the guiding of the pin 9 through the wall of the second binding part 6. Since a high degree of flexibility regarding the motions of the foot in all directions is desirable in snowboarding, but most snowboard boots in use with plate bindings have a relatively hard outer shell, this flexibility cannot be achieved by the shoe alone. For this reason, the pin 9 is flexibly supported in relation to the second binding part 6, which is rigidly connected to the boot. To this end, the pin 9 is supported so as to be displaceable in a metal casing 69, which is in turn connected to the second binding part 6 by an elastic casing 68. This elastic casing 68 can consist, for instance, of rubber or some other resilient material, such as an elastic plastic. In manufacturing the second binding part 6, the plastic "shell" of which is produced by injection molding technology, it is possible to mold on this flexible casing 68 in a second work step in the same injection molding form, which means that the casing 68 also obtains a very good connection to the binding part 6. Not only are shocks dampened and absorbed by this resilient supporting of the pins, which absorb the essential forces between the snowboard and the boot, the boot can also be tilted in an angle of 1°–3° perpendicular to the longitudinal direction, which considerably increases comfort in use.

It can also be recognized from FIG. 12*a* how the spring 28 is supported on the pin 9. In the embodiment example shown here, the latter has a radially projecting collar 67, which, on one hand, serves as a stop that defines the limit position of the bolt and, on the other, supports the spring 28. Here the spring has a drillhole 28' through which projects the interior end of the pin, to which in turn the articulated lever 60 (FIG. 12) is connected by way of the pivot bearing 61. It should be emphasized at this point that the flexible bearing of the pins according to FIG. 12*a* can be applied to the variants of the invention.

Alternative to or in combination with this flexible bearing of the pin, the first binding part 7 can also be flexibly attached to the snowboard, for example by inserting a resilient plate of rubber or flexible plastic between the snowboard surface and the first binding part (as will be explained more closely in connection with FIG. 14).

Figure 13:
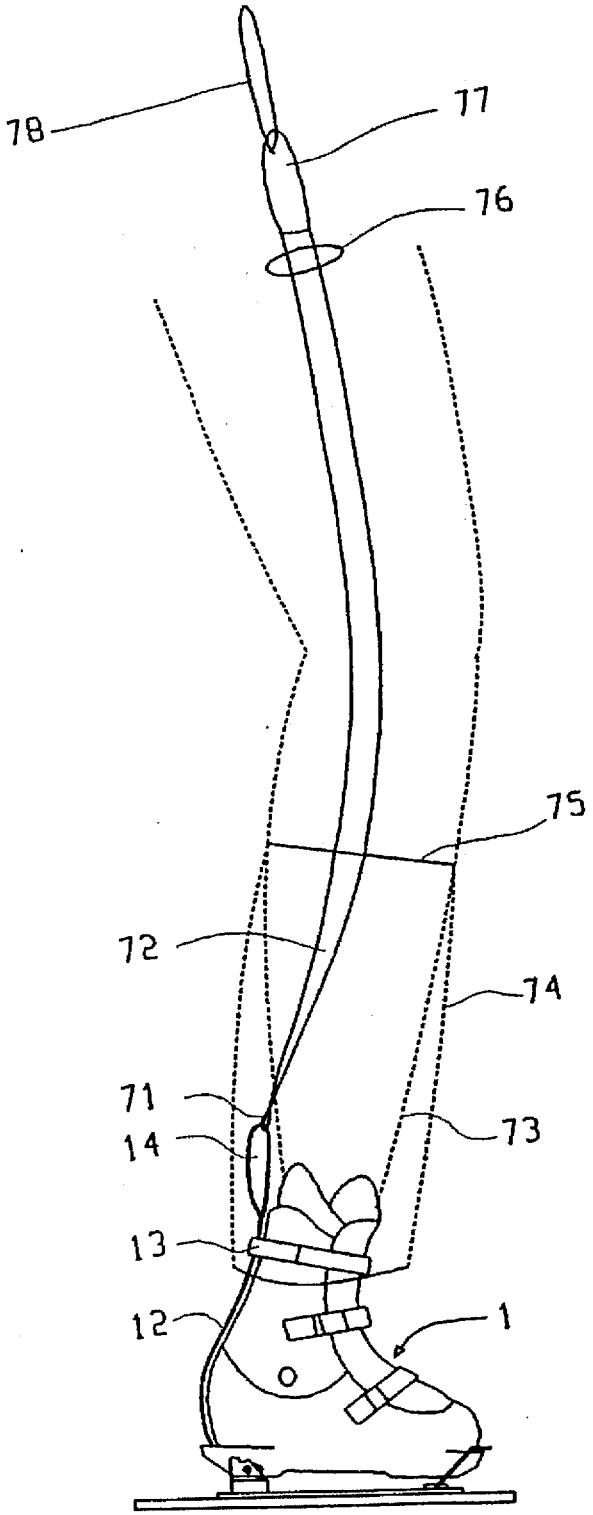
FIG. 13 a side view of the binding according to the invention with a boot and a leg of a snowboarder to illustrate another aspect of the invention.

FIG. 13 shows a refinement of the invention in which the tensile element 12 for opening the binding is extended further and is partially integrated into the snowboarder's clothing. The tensile element can thus be led upward to an arbitrary height to suit the comfort of the snowboarder. It has proven practical to guide the tensile organ roughly up to the height of the thigh, where it can be gripped by the snowboarder's hand without any bending at all. For this purpose, a loop 13 on upper end of the tensile element 12 is connected by a snap hook 71 or some other easily operated suspension device to an extension belt 72, preferably guided in the interior of the snowboard pants and only emerging at an opening 76. There the extension belt 72 has another loop 77 that can be gripped by hand. This loop 77 is held in position by an rubber belt 78 fastened, for instance, to the belt of the pants or a loop sewed onto the pants.

Most contemporary snowboard pants have a sleeve 74 that is sewn onto the pants along a seam 75 at the level of the shin and extends partially over the upper part of the boot 1. The extension belt 72 is guided in this area between the pants 73 and the sleeve 74. When the snowboarder puts on the boot 1, he need only connect the extension belt 72 to the loop 14 of the tensile element 12 with the snap hook 71 and then has the additional comfort in operating the binding all day long.

FIG. 14 shows an additional variant of the invention that can in principle be applied to all embodiment examples. The shoe-side second binding part is no longer accommodated here in the heel area but instead, approximately in the middle of the boot 1. Correspondingly, the snowboard-side binding part 7 is attached in a central position to the snowboard. Thus the boot is fastened only by the two pins and no longer by a front stirrup. In order to prevent swiveling of the boot about the rotational axis of the pins, tread plates 80, 81 are applied to the snowboard surface in the area of the heel and toe. These tread plates 80, 81 are preferably made of a resilient material in order to bring about a dampening and absorption of shocks and to allow a certain flexibility for a relative motion of the boot with respect to the snowboard. The tensile element 12 is effectively connected to the pins as in the other embodiment examples, so that the binding otherwise operates in the manner described above. Since in this variant, the boot need not be pushed forward against a front stirrup, the lateral cheeks 7 of the snowboard-side binding part are configured somewhat differently. The upper side of the lateral cheeks has two guide surfaces 10,10' arranged in a V-shape and terminating in a circular dimple 17. By means of these guide surfaces 10,10', the boot is led in the direction towards the dimple 17 when the pins are placed on these guide surfaces, where then, according to the embodiment example of FIGS. 3 and 3*a* the dimple 22 insures that the pins are pressed inward and only go into their locking position upon reaching the opening 8.

In order to make the entire binding somewhat more elastic, an additional resilient block 82 is inserted here between the surface of the snowboard S and the snowboard-side first binding part 7.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

We claim:

1. A snowboard binding for releasably binding a snowboard boot to a snowboard for use by a snowboarder, the snowboard having an upper surface to which the snowboard boot is bound, the snowboard boot having an upper, a toe, a sole, and a heel attached to the sole, the snowboard binding comprising:

a first binding element to be firmly connected to the snowboard;

a second binding element to be firmly connected to the snowboard boot and extending on both sides of the boot sole, said second binding element being lockable to the first binding element via a connection;

wherein said second binding element comprises two pins loaded by a spring and projecting from the second binding element laterally beyond the outer surface of the boot sole;

wherein the first binding element has two lateral cheeks substantially parallel to each other and substantially perpendicular to the snowboard's upper surface with a spacing between the cheeks for receiving lateral sides of the boot sole, each cheek having an opening therein for receiving the pins projecting from the second binding element; and wherein actuation of a pivoting lever within the second binding element retracts the pins.

2. The snowboard binding according to claim 1 wherein each pin is connected to the pivoting lever by an articulated lever connected to first and second ends, respectively, of the pivoting lever, with the articulated lever for each pin being supported so as to pivot with respect to the pivoting lever and with respect to the pins; and wherein a tensile element is mounted at one end of the pivoting lever and runs essentially at a right angle to the longitudinal axis of the pivoting lever.

3. A snowboard binding for releasably binding a snowboard boot to a snowboard for use by a snowboarder, the snowboard having an upper surface to which the snowboard boot is bound, the snowboard boot having an upper, a toe, a sole, and a heel attached to the sole, the snowboard binding comprising:

a first binding element to be firmly connected to the snowboard;

a second binding element to be firmly connected to the snowboard boot and extending on bottom side of the boot sole, said second binding element being lockable to the first binding element via a connection; and an unlocking device associated with the snowboard boot for loosening the connection between the two binding elements, said unlocking device being operable manually by an operating element associated with the snowboard boot;

said second binding element comprising two pins loaded by a spring and projecting from the second binding element laterally beyond the outer surface of the boot sole;

said first binding element having two lateral cheeks substantially parallel to each other and substantially perpendicular to the snowboard's upper surface with a spacing between the cheeks for receiving lateral sides of the boot sole, each cheek having an opening therein for receiving the pins projecting from the second binding element;

said unlocking device having means to retract the pins against the force of spring and from the openings in the cheeks.

4. The snowboard binding according to claim 3 wherein each lateral cheek of the first binding element has an incline declining in the direction of a front stirrup; and wherein the sole of the snowboard boot has projections thereon which are spaced from the pins and offset in the direction of the boot toe, which projections have flat surfaces cooperating with the inclines such that the boot is automatically pressed forward in the direction of said front stirrup when the heel is pressed down.

5. The snowboard binding according to claim 3 wherein each of the lateral cheeks has a dimple on its end facing away from the upper surface of the snowboard for guiding the pins.

6. The snowboard binding according to claim 5 wherein each of the lateral cheeks has a dimple running in an inclined direction starting from the free end of the lateral cheeks up to the opening in each of the lateral cheeks.

7. The snowboard binding according to claim 3 wherein the two lateral cheeks are connected by a connection element situated perpendicular to the lateral cheeks; and wherein the spacing from the central axis of the openings to the connection element is greater than the spacing between the central axis of the pins of the second binding element and the lower side of the snowboard sole.

8. The snowboard binding according to claim 7 wherein the lateral cheeks and the connection element are supported so as to be displaced parallel above the upper surface of the snowboard on a guide block to be fastened to the snowboard with screws; and wherein the lateral cheeks are held in place in a direction perpendicular to the snowboard surface by arms reaching over the guide block.

9. The snowboard binding according to claim 3 wherein each pin is connected by an articulated lever to first and second ends, respectively, of a pivoting lever, with the articulated lever for each pin being supported so as to pivot with respect to the pivoting lever and with respect to the pins; and wherein a tensile element is mounted at one end of the pivoting lever and runs essentially at a right angle to the longitudinal axis of the pivoting lever.

10. The snowboard binding according to claim 3 wherein an elastic support elastically supports the pins of the second binding element, the elastic support being retained within a resilient casing.

11. The snowboard binding according to claim 3 wherein an actuation element is led upward to the boot upper inside the shoe liner and a shell of the snowboard boot.

12. The snowboard binding according to claim 11 wherein the actuation element is extended beyond the boot's uppers and substantially to the level of the snowboarder's hip.

13. The snowboard binding according to claim 3 wherein the second binding element is located at the middle of the snowboard boot between its heel and toe.

14. The snowboard binding according to claim 13 wherein resilient tread blocks are mounted on the snowboard in tread areas of the heel and toe of the snowboard boot.

15. The snowboard binding according to claim 3 wherein a resilient bearing block is arranged between the snowboard surface and the first binding element attached to the snowboard.

16. The snowboard binding according to claim 3 wherein the binding has a front stirrup reaching over the snowboard boot sole in the front area and wherein the second binding element is located in the heel area of the snowboard boot.

17. The snowboard binding according to claim 3 wherein the two pins are pressed apart by a strap spring which has a substantially U-shape when seen from above.

18. The snowboard binding according to claim 17 wherein tensile elements wrap around a post in opposite directions and are connected to an actuation element configured as a cable with the actuation element being guided out through an opening to the outside of the snowboard boot, the tensile elements being attached to both pins or to the ends of the strap spring firmly connected to these pins.

19. The snowboard binding according to claim 3 wherein the pins are pressed apart by a coil spring; and wherein the unlocking device consists of a lever for each pin which is supported so as to pivot about an axis of rotation, the lever for each pin being supported on a thickening on the inner end of the respective pins, the lever for each pin being connected to an actuation element configured as a cable.

20. The snowboard binding according to claim 19 wherein the lever for each pin is curved in a convex shape in the contact area with the thickening of each pin.

21. The snowboard binding according to claim 3 wherein the two pins are pressed outward by a coil spring and wherein the locking device has levers seated so as to pivot, each of which levers has a slot and is connected to one of the pins by a bolt inserted perpendicularly to the longitudinal axis of the respective pin into the respective slot.

22. The snowboard binding according to claim 3 wherein the pins have arms bent over inside of the second binding element and wherein the bent arms are connected together by a pivot lever which is directly or indirectly connected to an actuation element configured as a cable.

23. The snowboard binding according to claim 3 wherein the pins are arranged on the inside of the second binding element;

wherein the pins are offset and overlap one another at overlapping areas;

wherein the pins have bolt openings with inclined planes in the overlapping areas; and wherein a bolt with corresponding opposite inclined planes is inserted into the bolt openings, which bolt is connected to an actuation element configured as a cable.

* * * * *